United States Patent [19]

Vlaanderen

[11] Patent Number: 5,014,863

[45] Date of Patent: May 14, 1991

[54] VEHICLE MOUNTED CRANE

[75] Inventor: James Vlaanderen, Garner, Iowa

[73] Assignee: Iowa Mold Tooling Company, Inc., Garner, Iowa

[21] Appl. No.: 339,067

[22] Filed: Apr. 14, 1989

[51] Int. Cl.[5] ..... B66C 23/00

[52] U.S. Cl. ..... 212/182; 212/189; 212/261; 212/264; 414/543; 414/546; 414/550

[58] Field of Search ..... 414/541, 542, 543, 546, 414/552, 553, 917; 212/183, 188, 258, 261, 256, 260, 182, 189, 264

[56] References Cited

U.S. PATENT DOCUMENTS

| | | | |
|---|---|---|---|
| 2,911,111 | 11/1959 | Grove | 212/261 X |
| 3,174,630 | 3/1965 | Tantlinger et al. | 212/258 X |
| 3,285,445 | 11/1966 | Broziat | 212/183 |
| 3,513,997 | 5/1970 | Heyer et al. | 414/541 |
| 3,718,221 | 2/1973 | Visser | 212/258 X |
| 3,952,890 | 4/1976 | Armstrong | 414/917 X |
| 4,218,171 | 8/1980 | Guinot | 414/917 X |
| 4,659,276 | 4/1987 | Billett | 414/917 X |

FOREIGN PATENT DOCUMENTS

| | | | |
|---|---|---|---|
| 0162748 | 5/1955 | Australia | 414/543 |
| 0555862 | 4/1958 | Canada | 414/542 |
| 1291081 | 3/1969 | Fed. Rep. of Germany . | |
| 2325029 | 11/1973 | Fed. Rep. of Germany . | |
| 2304786 | 8/1974 | Fed. Rep. of Germany . | |
| 2941813 | 5/1981 | Fed. Rep. of Germany | 212/183 |
| 6603732 | 9/1966 | Netherlands | 414/541 |
| 1079159 | 8/1967 | United Kingdom | 212/183 |

*Primary Examiner*—Robert J. Spar
*Assistant Examiner*—John VandenBosche
*Attorney, Agent, or Firm*—Wood, Phillips, Mason, Recktenwald & Vansanten

[57] ABSTRACT

The possibility of the end 26 of a boom 20 of a vehicle mounted crane being moved downwardly into engagement with part of the crane or the vehicle on which it is mounted and causing damage thereto during elevation of a mast 18 for the crane from a stowed position (FIG. 2) to an elevated position (FIG. 1) is avoided in a construction wherein the mast 18 is formed of a parallelogram linkage including rigid links 60 and cylinders 72 which assure that the attitude of the boom 20 relative to a base 10 for the crane will not change during elevation of the mast 18.

13 Claims, 2 Drawing Sheets

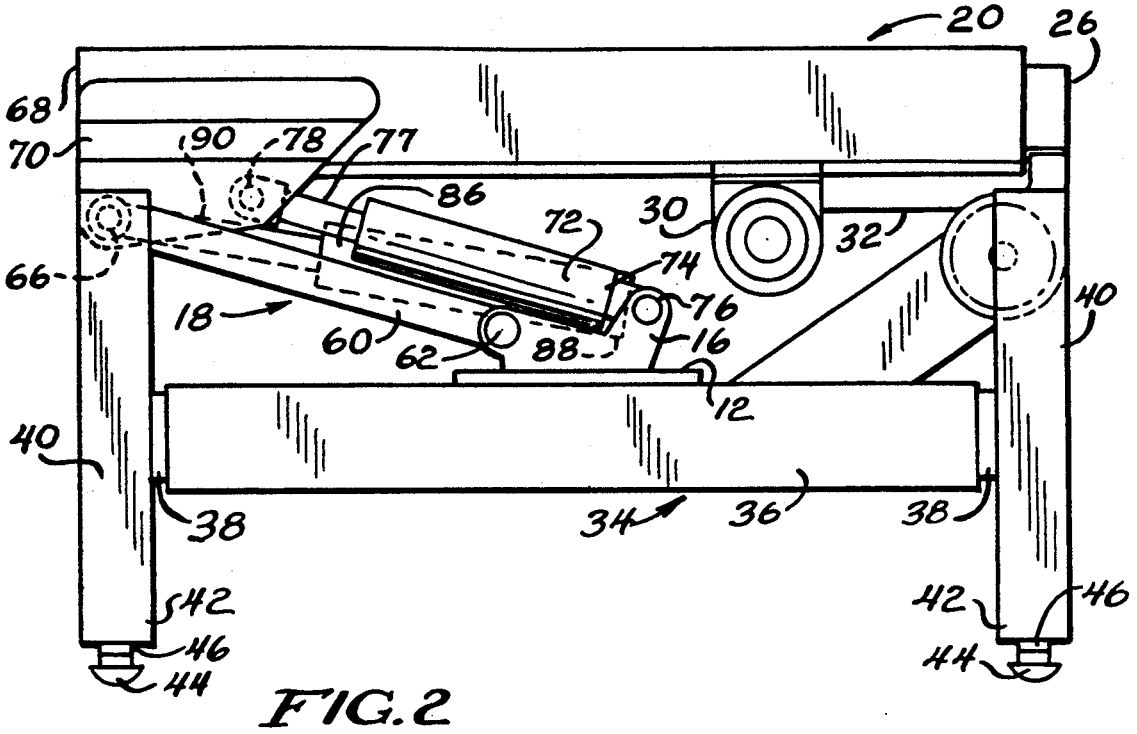
FIG. 2
FIG. 3
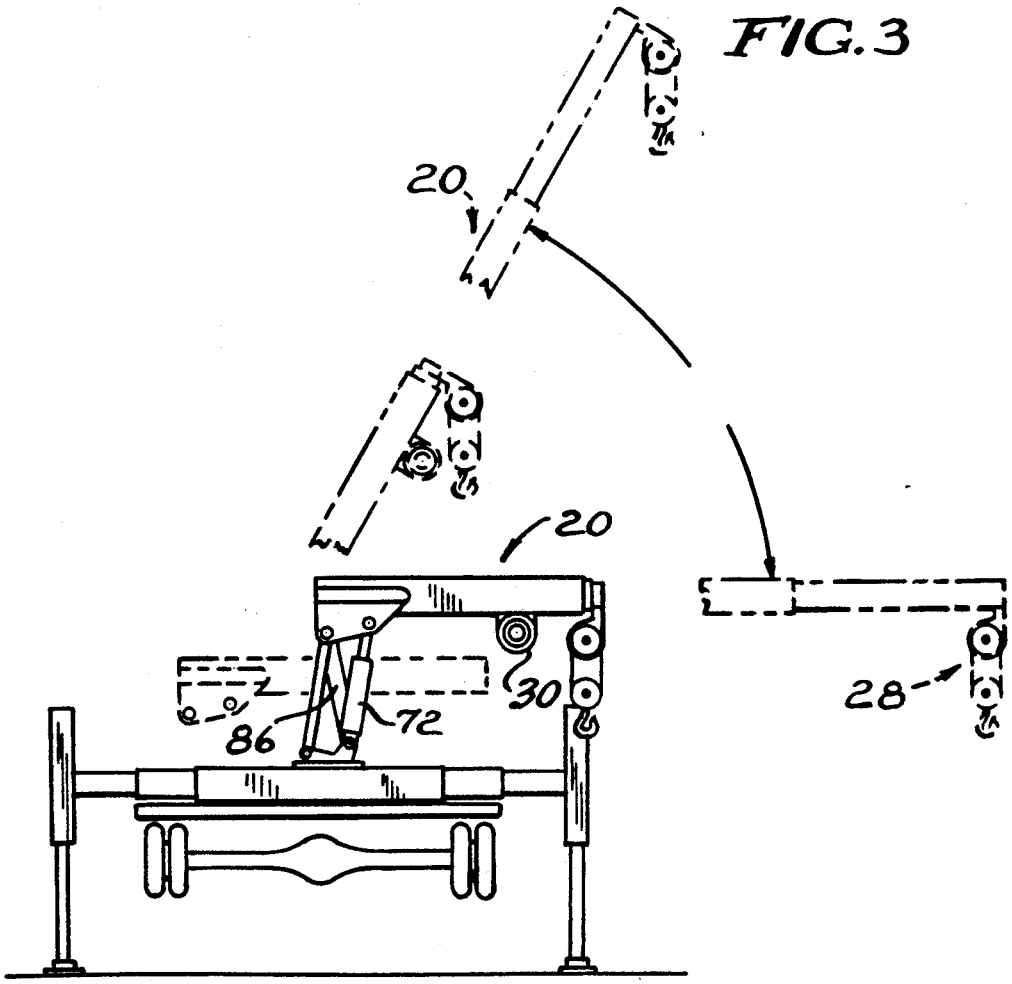

VEHICLE MOUNTED CRANE

FIELD OF THE INVENTION

This invention relates to a crane adapted to be mounted on a vehicle, and more particularly, to such a crane having a mast movable between collapsed and extended positions.

BACKGROUND OF THE INVENTION

Vehicle mounted cranes have become increasingly popular in recent years. Conventionally, they are mounted on the bed of a truck adjacent one end or another and are employed for loading and unloading any of a wide variety of material to and from the truck.

Typical usages include the transportation of building materials such as pallets of construction supplies, large and/or heavy conduits and the like.

Such cranes are also employed to do jobs in addition to loading and unloading functions. For example, they are frequently employed in connection with the servicing of tires for off-the-road vehicles. See, for example, commonly assigned Francis L. Zrostlik U.S. Pat. No. 3,927,778 issued Dec. 23, 1975 and Francis L. Zrostlik et al. U.S. Pat. No. 4,314,597 issued on Feb. 9, 1982.

Wherever possible, it is highly desirable that a crane that is to be mounted on a vehicle be such that it can be configured to a stowed position which will fit inside the envelope of the vehicle as, for example, the envelope defined by the cab and the bed. One crane meeting this objective is disclosed in commonly assigned Larry J. Hejlik U.S. Pat. No. 4,623,067 issued Nov. 18, 1986, the details of which are incorporated by reference. In constructions of this sort, the crane will typically include a base which is adapted to be mounted on the vehicle frame or the bed thereof. A mast is pivoted to the base for movement between an elevated position and a lowered or stowed or collapsed position. In the elevated position, a boom is moved relative to the mast and is provided with sufficient height to accomplish its intended purpose. When the vehicle is in transit, however, it is desirable to maintain the entire crane within the vehicle envelope as alluded to previously and accordingly, the mast will be moved to a collapsed or stowed position. This in turn lowers the height of the boom to bring it within the envelope of the vehicle.

In certain cranes of this type, particularly those having telescoping booms which overly the mast when in the collapsed position as opposed to those having articulated booms, when the mast is moved to its elevated position by pivoting about a horizontal axis, the resulting movement tends to pivot the end of the boom downwardly into the vehicle frame. If the operator is not careful, it is possible to damage the crane when the end of the boom undesirably comes into contact with the vehicle frame or truck bed. Damage to the vehicle could also result.

In order to avoid this possibility, in prior art cranes of this sort, it has been necessary to operate two controls substantially simultaneously. One control is that used to control a motor, usually a hydraulic cylinder, employed to elevate the mast relative to the base. The second control is for a motor, again usually a hydraulic cylinder, that is utilized to change the attitude of the boom relative to the mast so that the end of the boom will not move downwardly as the mast is being elevated.

Proper usage of the two controls substantially simultaneously takes dexterity and alertness on the part of the operator; if not performed properly, damage as mentioned previously can result.

The present invention is directed to overcoming one or more of the above problems.

SUMMARY OF THE INVENTION

It is a principal object of the invention to provide a new and improved vehicular mounted crane. More specifically, it is an object of the invention to provide such a crane wherein the mast of the crane may be moved from a stowed or collapsed position to an elevated position using but a single control and without concern that the crane boom will be brought into undesirable contact with the vehicle as the mast is being elevated.

An exemplary embodiment of the invention achieves the foregoing objects in a crane construction including a base. A boom is located above the base an includes first and second opposed ends. Load lifting means are located on the boom at the first end thereof and a collapsible mast interconnects the boom second end and the base. The mast includes a rigid link pivoted at a first pivot to the base and at a second spaced pivot to the boom along with a variable length link that is generally parallel to the rigid link and is pivoted at a third pivot to the base and at a fourth pivot to the boom. The variable length link is operable to raise and lower the boom on the mast when its length is changed.

The distance between the first and third pivots and the second and fourth pivots is substantially equal and the variable length link is configurable to have a length substantially equal to the length of the rigid link to define a parallelogram linkage. A motor is connected to the parallel linkage for changing the distance between opposite corners thereof. As a consequence, the mast may be collapsed or extended o the base by operation of the motor without changing the attitude of the boom relative to the base. This in turn assures that during elevation of the mast, an end of the boom will not be moving downwardly toward the base to engage the same.

In a highly preferred embodiment, the motor is a cylinder connected in the parallelogram linkage in diagonal relation to the rigid and variable length links. Preferably, the cylinder extends between opposed ones of the pivots.

The invention contemplates the provision of an upwardly opening cradle on the base for receiving the boom when the mast is telescoped and stowed. In a highly preferred embodiment, an outrigger assembly is attached to the base. The outrigger assembly includes spaced, vertically movable, ground engaging pads.

In a highly preferred embodiment, the outrigger assembly is also provided with telescoping elements so that the horizontal distance between the pads may be selectively varied.

The invention further contemplates that the variable length link be an additional cylinder.

According to this embodiment of the invention, there are two rigid lengths and two cylinders defining variable length links. The motor cylinder is nested between the links.

In a preferred embodiment, the boom includes at least two telescoping members.

The boom may be provided with load lifting means in the form of a block and tackle at the boom first end. The boom may also mount a winch which in turn is connected to the block and tackle.

Other objects and advantages will become apparent from the following specification taken in connection with the accompanying drawings.

DESCRIPTION OF THE DRAWINGS

FIG. 2 is a side elevation of the crane with the mast in a collapsed or stowed position; and FIG. 3 is a somewhat schematic view of the crane illustrating somewhat schematically the position of part of the boom with the mast in both the elevated and stowed or collapsed positions.

DESCRIPTION OF THE PREFERRED EMBODIMENT

Figure 1:
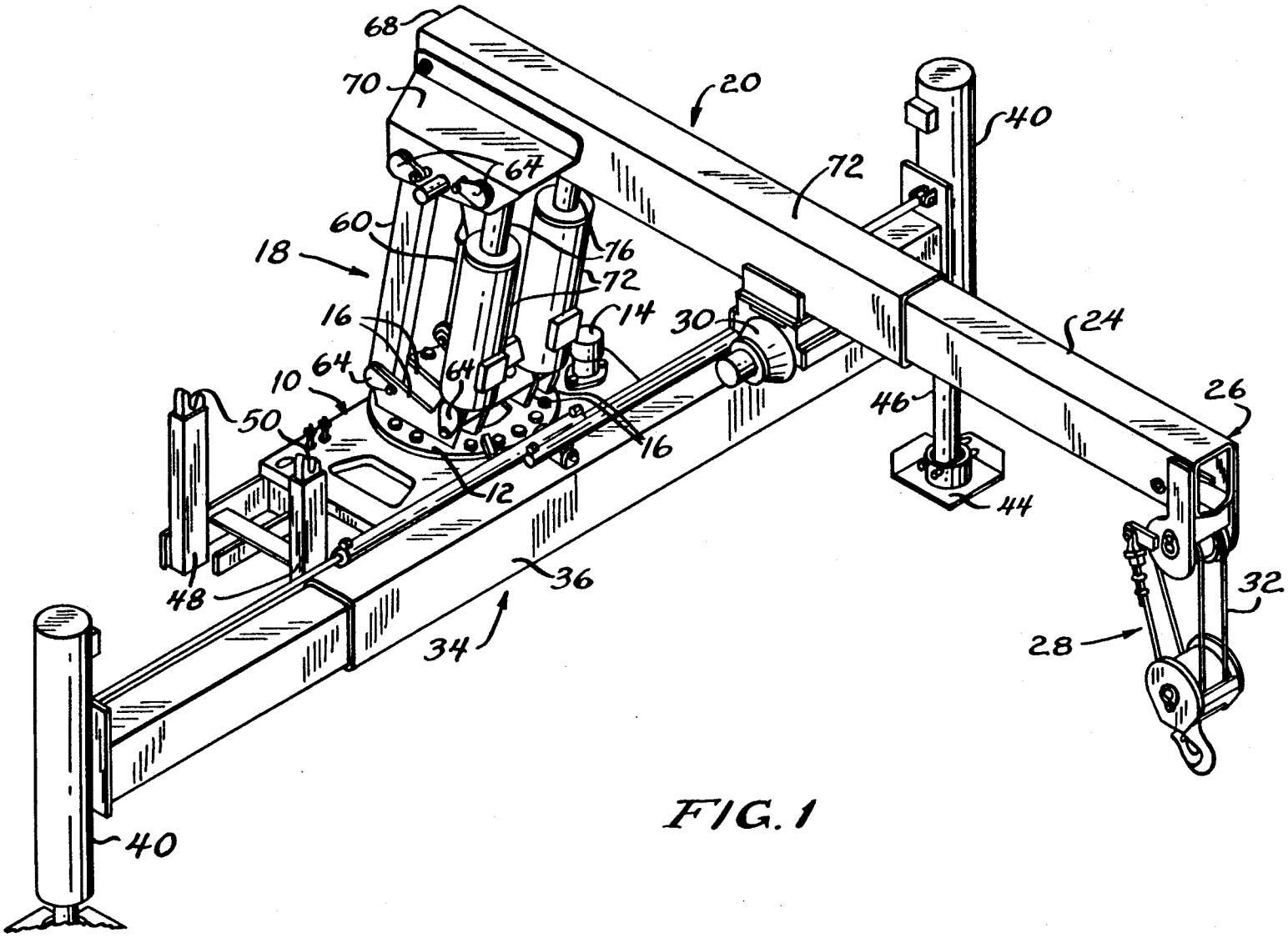
FIG. 1 is a perspective view of a vehicle mounted crane made according to the invention with the mast in an elevated position.

An exemplary embodiment of the invention is illustrated in the drawings and with reference to FIG. 1 is seen to include a base, generally designated 10, made of metal plates or the like.

A circular plate 12 is journaled on the base 10 by means not shown for rotation about a vertical axis. A hydraulic motor 14 mounted on the base 10 is connected by any suitable linkage to the plate 12 to rotate the same.

Mounted on the plate 12 in spaced, generally parallel relation, are four upstanding mounting plates 16. The mounting plates 16 operate to mount a collapsible mast, generally designated 18, to the plate 12 as will be described in greater detail hereinafter, and thus to the base 10. Thus, the mast 18 may be pivoted about a vertical axis.

At the upper end of the mast 18 is a boom, generally designated 20. As illustrated in FIG. 1, the boom is made up of at least two telescoping rectangular tubes 22 and 24, the latter telescopingly received within the former. A cylinder (not shown) may be conventionally employed to extend or retract the tube 24 within the tube 22 to selectively vary the length of the boom 20.

At an end 26 of the tube 24 remote from the mast 18, the boom 20 includes a load lifting means in the form of a conventional block and tackle 28.

The tube 22 may mount a hydraulically driven winch 30 which is connected to the cable 32 forming part of the block and tackle 28.

Also mounted to the base 10 is an outrigger assembly, generally designated 34. As can be seen in the drawings, the outrigger assembly 34 includes a central rectangular tube 36 from which smaller, rectangular tubes 38 extend at opposite ends. Any known means, as, for example, hydraulic cylinders (not shown), disposed within the tube 34 may be utilized to move the tubes 38 into and out of the tube 36.

The end of each of the tubes 38 mounts a vertically disposed cylinder 40 having its rod end 42 lowermost. Ground engaging pads 44 may be located on the rods 46 of the cylinders 40 which may then be extended to bring the pads 44 into engagement with the underlying terrain to steady the base 10 relative thereto.

One side of the base 10 may also mount spaced upwardly extending arms 48 which terminate in upwardly opening recesses 50. By suitable rotation of the plate 12, the boom 20 may be located essentially between the arms 48 and, with the tube 24 retracted and the mast 18 collapsed, nested within the recesses 50 which, together with the arms 48, act as a cradle for the boom when the vehicle is in transit.

Returning to the mast 18, the same is made up of two rigid, inextensible links 60 which are aligned with one another and which are connected by aligned pivot pins 62 to the mounting plates 16 at the side thereof opposite the end 26 of the boom 20. As shown in FIG. 1, removable egg shaped retaining plates 64 may be utilized to cover the pivots 62.

The opposite ends of the links 60 are pivoted by pivot pins 66 adjacent the end 68 of the boom 20 remote from the end 26 and located in ears 70 extending from opposite sides of the boom 20 at the end 68. Again, retaining plates 64 may be utilized to overly the pivot pins 60.

The mast 18 also includes a pair of hydraulic cylinders 72. The hydraulic cylinders 72 have their head ends 74 pivoted to the mounting plates 16 by aligned pivot pins 76 which in turn may be covered by retaining plates 64. The rods 77 of the cylinders 72 are pivoted by pins 78 to the ears 70 and again, retaining plates 64 utilized.

In actuality, a single elongated pin may be used for the pins 66 and 76 for purposes to be seen.

The resulting configuration is that of a parallelogram linkage in that, as can be plainly seen in FIG. 2, the distance between the pivots 66 and 78 is identical to the distance between the pivots 62 and 76. In addition, the cylinder 72 is sized so that it can be made to equal the length of the links 60 as, for example, when fully retracted. Thus, when fully retracted, the distance between the pivots 78 and 76 will equal the distance between the pivots 66 and 62 to form a true parallelogram linkage.

This in turn means that the attitude of the boom 20, when horizontal as shown in FIG. 2, will not change relative to the base 10 as the mast 18 is moved between the collapsed or stowed position (FIG. 2) and the extended or elevated position (FIG. 1). That in turn means that the end 26 of the boom 20 cannot move downwardly when the mast 18 is extended as can occur in prior art constructions and result in damage thereto or to the frame of the vehicle on which the crane is mounted.

At the same time, the cylinder 72 may be controlled by conventional valving to pivot the boom 20 about a pivot axis coextensive with the pivot pins 66 between the raised and lowered positions illustrated in FIG. 3 and the block and tackle 28 operated as desired through appropriate energization of the winch 30 to perform whatever jobs be required.

It will also be appreciated that the boom 20 may be rotated relative to the vehicle on which the crane is mounted through appropriate energization of the motor 14 and the resulting rotation of the plate 20 on the base 10.

To move the mast 18 between the collapsed position and the extended position, an additional hydraulic cylinder 86 is utilized. The cylinder 86 has its head end 88 pivoted to the base on the pivot pin 76 and is located so as to be nested between the cylinder 72. The rod 90 of the cylinder 86 is connected to the boom 20 by being pivoted to the pivot pin 66. The rod 90 is nested between the rigid links 60. Because of the nesting of the components, a single pivot may be used for the pivot pins 66 and 76 as mentioned previously.

As a result of this configuration, the cylinder 86 extends between opposed pivots of the parallelogram linkage comprising the mast 18 and in diagonal relationship to the links defined by the rigid links 60 and the cylinders 72. When the cylinder 86 is fully extended as illustrated in FIG. 2, the mast 18 will be moved to its fully stowed or collapsed position. Conversely, by retracting the cylinder 86, the mast 18 will be elevated to the position illustrated in FIG. 1.

During such elevation, the attitude of the boom 20 relative to the base 10 will remain the same because of the parallelogram linkage construction of the mast 18. Thus, the operator need not concern himself with simultaneous control of the cylinder 86 to elevate the mast and control of the cylinder 72 to prevent the end 26 of the boom from undesirably engaging some part of the crane or the vehicle on which it is mounted as is the case with prior art constructions. Thus, effective operation is made simpler through the use of the invention and the possibility of damage to the end of the boom during mast extension is eliminated entirely.

I claim:

1. A crane construction comprising:

a base;

outriggers secured to said base and having vertically movable, ground engaging pads adapted to steady said base in relation to the underlying terrain;

a boom located above said base and including first and second, opposed ends;

load lifting means on said boom at said first end; and a collapsible mast interconnecting said boom second end and said base, said mast including a rigid link pivoted at a first pivot to said base and at a second, spaced pivot to said boom, a first extensible cylinder having a rod generally parallel to said link pivoted at a third pivot to said base and a fourth, spaced pivot to said boom and operable to raise or lower said boom on said mast, the distance between said first and third pivots, and said second and fourth pivots being substantially equal, said first cylinder being configurable to have a length substantially equal to the length of said rigid link to define a parallelogram linkage, and a second extensible cylinder extending diagonally between and pivotally connected to opposite corners of said parallelogram linkage;

whereby said mast may be collapsed or extended on said base by operation of said second cylinder and without changing the attitude of said boom relative to said base.

2. The crane construction of claim 1 wherein said mast is pivotally mounted for rotation about a vertical axis on said base.

3. The crane construction of claim 1 wherein said fourth pivot is located between said second pivot and said boom first end.

4. The crane construction of claim 3 wherein said second cylinder extends between said second and third pivots.

5. The crane construction of claim 4 wherein there are two said links and two said first cylinders, and said second cylinder is nested between said links and said first cylinders.

6. The crane construction of claim 5 wherein said boom includes at least two telescoping members and said load lifting means comprises a block and tackle at said boom first end.

7. The crane construction of claim 6 wherein a boom member remote from said first end mounts a winch connected to said block and tackle.

8. A crane construction adapted for mounting on a vehicle comprising:

a base;

a boom located above said base and including first and second, opposed ends;

load lifting means on said boom at said first end; and a collapsible mast interconnecting said boom second end and said base, said mast including a rigid link pivoted at a first pivot to said base and at a second spaced pivot to said boom, a variable length link generally parallel to said rigid link and pivoted at a third pivot to said base and a fourth spaced pivot to said boom and operable to raise or lower said boom on said mast, the distance between said first and third pivots, and said second and fourth pivots being substantially equal, said variable length link being configurable to have a length substantially equal to the length of said rigid link to define a parallelogram linkage and an extensible cylinder extending diagonally between and pivotally connected to opposite corners of said parallelogram linkage;

whereby said mast may be collapsed or extended on said base by operation of said cylinder and without changing the attitude of said boom relative to said base.

9. A vehicle mounted crane construction comprising:

a base adapted to be mounted on a vehicle;

a boom located above said base and including first and second, opposed ends;

load lifting means on said boom at said first end; and a collapsible mast interconnecting said boom second end and said base, said mast including a rigid link pivoted at a first pivot to said base and at a second spaced pivot to said boom, a variable length link generally parallel to said rigid link and pivoted at a third pivot to said base and a fourth, spaced pivot to said boom and operable to raise or lower said boom on said mast, the distance between said first and third pivots, and said second and fourth pivots being substantially equal, said variable length link being configurable to have a length substantially equal to the length of said rigid link to define a parallelogram linkage and a motor for changing the distance between opposite corners of said parallelogram linkage;

whereby said mast may be collapsed or extended on said base by operation of said motor and without changing the attitude of said boom relative to said base.

10. The crane construction of claim 9 wherein said motor is a cylinder connected in said parallelogram linkage in diagonal relation to said links.

11. The crane construction of claim 10 wherein said cylinder extends between opposed ones of said pivots.

12. The crane construction of claim 11 further including upwardly opening cradle means on said base for receiving said boom when said boom is telescoped and said mast is collapsed.

13. The crane construction of claim 12 further including an outrigger assembly secured to said base, said outrigger assembly including spaced, vertically movable, ground engaging pads and telescoping elements whereby the horizontal distance between said pads may be selectively varied.

* * * * *